United States Patent [19]

Keglewitsch

[11] 3,976,350

[45] Aug. 24, 1976

[54] ELECTRICAL CONNECTOR ASSEMBLY HAVING INSULATED INSULATION PIERCING CONTACT PORTIONS

[75] Inventor: Josef Keglewitsch, Addison, Ill.

[73] Assignee: Bunker Ramo Corporation, Oak Brook, Ill.

[22] Filed: Oct. 21, 1974

[21] Appl. No.: 516,377

[52] U.S. Cl. ..... 339/97 P

[51] Int. Cl.[2] ..... H01R 9/08

[58] Field of Search ..... 339/97 R, 97 P, 98, 339/99 R

[56] References Cited

UNITED STATES PATENTS

| | | | |
|---|---|---|---|
| 2,501,187 | 3/1950 | Oortgijsen | 339/97 P X |
| 3,573,713 | 4/1971 | Erright et al. | 339/98 |
| 3,683,319 | 8/1972 | Vigeant et al. | 339/97 R |
| 3,824,530 | 7/1974 | Roberts et al. | 339/99 R |
| 3,825,881 | 7/1974 | Wigby | 339/97 R |
| 3,858,159 | 12/1974 | Worth | 339/99 R |
| 3,860,318 | 1/1975 | Reauis et al. | 339/99 R |

*Primary Examiner*—Joseph H. McGlynn
*Assistant Examiner*—Howard N. Goldberg
*Attorney, Agent, or Firm*—William Lohff; F. M. Arbuckle

[57] ABSTRACT

A patchcord type electrical connector assembly includes an array of electrical contacts which have insulation piercing contact portions which are shielded and insulated by housing portions which have conductor receiving slots aligned with the respective insulation piercing contact portions. Each of the conductor receiving slots includes at least one recessed area for receiving and holding a conductor as a part of a strain relief mechanism.

7 Claims, 4 Drawing Figures

ELECTRICAL CONNECTOR ASSEMBLY HAVING INSULATED INSULATION PIERCING CONTACT PORTIONS

BACKGROUND OF THE INVENTION

1. Field of the Invention

This invention relates to an electrical connector assembly, and more particularly to a patchcord type electrical connector assembly in which each of the electrical contacts of an array of contacts includes an insulation piercing portion which is housed within a respective electrical insulator.

2. Description of the Prior Art

Electrical connector assemblies comprising an array of electrical contacts are well known in the art. One type of such electrical connector assembly is widely used for patchcord applications and generally comprises a plurality of electrical contacts mounted in respective housings which are supported by a mounting plate. Each of the contacts includes a first portion for engaging a mating contact of a cooperable connector unit and a terminating portion which extends from the housing for connection to an electrical conductor. Heretofore, it has been necessary to strip the insulation from the electrical conductor so that the same may be soldered to or wrapped about the terminating portion of the contact. It is therefore readily apparent that termination of these contacts may become a time consuming procedure, particularly in applications where a great number of terminations are to be made. Also, there is also the possibility of short circuits being formed between the conductors or contacts, due to the close spacing of the contacts and the lack of electrical insulation.

SUMMARY OF THE INVENTION

It is the primary object of the present invention to provide an improved electrical connector assembly having an array of contacts which may be quickly electrically connected to respective electrical conductors.

Another object of the invention is to provide an electrical connector assembly in which the electrical contacts thereof have conductor terminating portions which are insulated from one another.

Another object of the invention is to provide an electrical connector assembly having an array of contacts which will receive and electrically contact a respective insulated conductor.

The above and other objects of the invention are realized by an electrical connector assembly which comprises a plurality of electrical contacts arranged and supported as an array of contacts. Each of the contacts includes a first portion which is adapted to engage a respective mating contact of a connector unit and an insulation piercing second portion including an insulation piercing slot for receiving and electrically contacting an insulated conductor. A separate electrical insulator, which is a portion of the contact housing, encloses the insulation piercing portion of the contact and includes a slot which is aligned with the insulation piercing slot for access to the insulation piercing slot by an insulated conductor.

The slot of the insulator includes an arcuate terminus which defines a terminal seating location for an insulated conductor and the insulator includes a pair of spaced flexible fingers which define the slot and which are moved away from each other as a conductor passes therethrough. As the conductor seats in the arcuate terminus, the elasticity of the fingers causes the same to move toward each other and provide strain relief.

Additional seating locations may be provided along the slot for subsequently terminated conductors by the provision of a bore having a diameter that is greater than the spacing of the flexible fingers.

The housing, including the insulator portion with the flexible fingers, may advantageously be molded from glass filled nylon which is a good electrical insulator and which may be produced in a variety of colors to aid in contact and circuit identification.

BRIEF DESCRIPTION OF THE DRAWING

Other objects, features and advantages of the invention, its organization, construction and operation, will be best understood from the following detailed description of a preferred embodiment of the invention taken in conjunction with the accompanying drawing, on which.

DESCRIPTION OF THE PREFERRED EMBODIMENT

Figure 1:
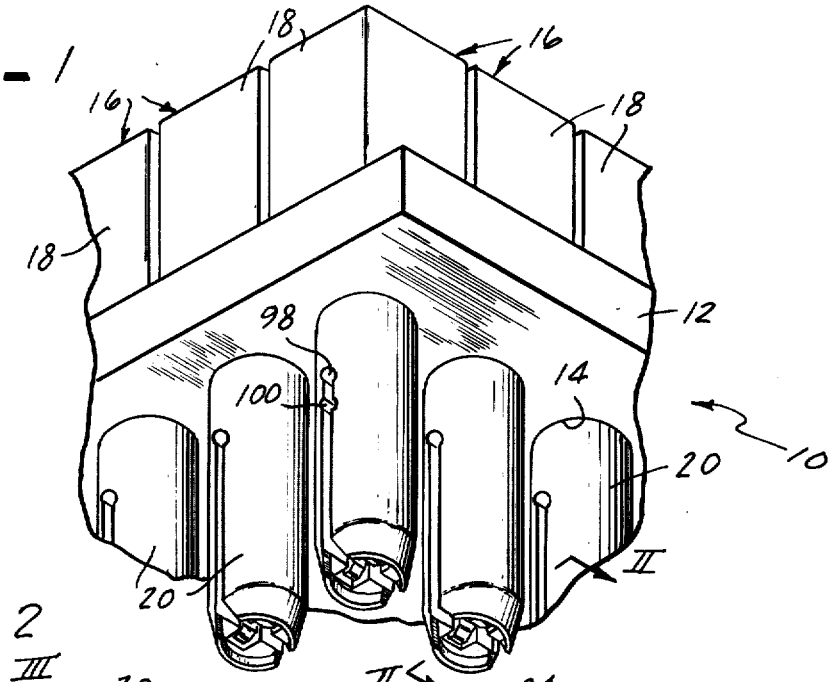
FIG. 1 is a perspective view of a portion of an electrical connector assembly constructed in accordance with the invention.

Referring first to FIG. 1, an electrical connector assembly is generally illustrated at 10 as comprising a mounting plate 12 having an array of apertures 14 therein for receiving portions of and mounting respective electrical connector units 16.

Each of the electrical connector units 16 includes an upper housing portion 18 for receiving a mating connector unit and a lower housing portion 20 which extends through the mounting plate 12 and houses an insulation piercing contact portion as described below with reference to FIGS. 2 and 3. The terms "upper" and "lower" are merely used herein with respect to the particular orientation illustrated on the drawing and it will be readily appreciated that the connector assembly may be supported in any desired orientation.

Figure 2:
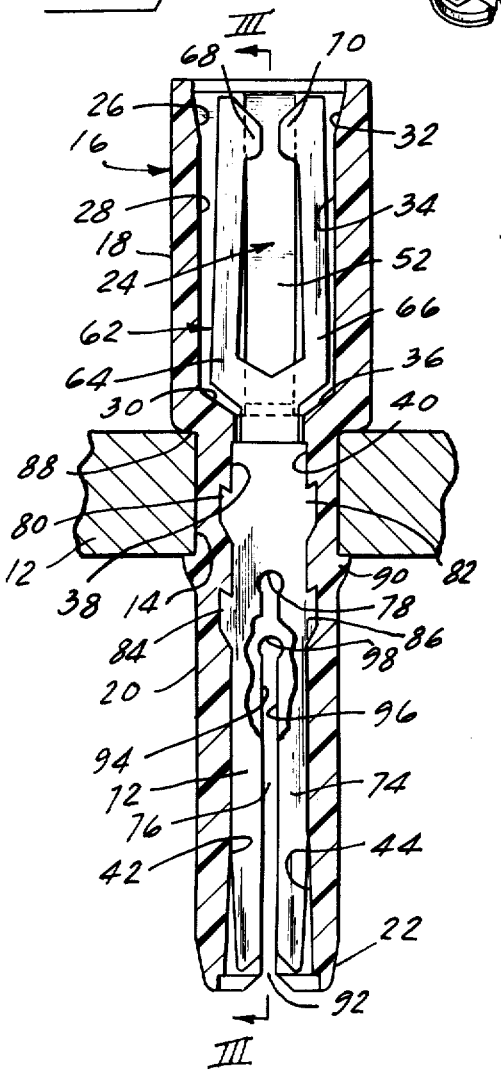
FIG. 2 is a sectional view of one connector unit taken substantially along the line II—II of FIG. 1.
Figure 3:
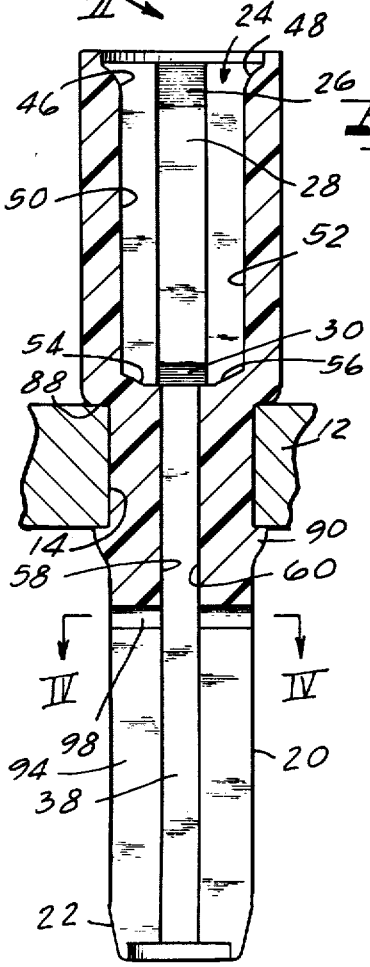
FIG. 3 is a sectional view of a connector unit taken substantially along the line III—III of FIG. 2, shown without the contact mounted therein.
Figure 4:
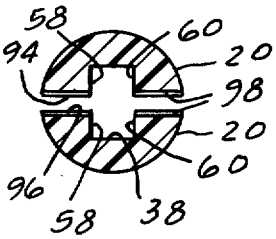
FIG. 4 is a sectional view taken substantially along the line IV–IV in FIG. 3.

Referring now to FIGS. 2, 3 and 4, the lower housing portion 20 is illustrated as comprising a tip 22 which extends beyond and protects the end of the electrical contact 62. The contact 62 is mounted in the housing and includes a bifurcated upper portion including a pair of arms 64 and 66 which carry respective contact projections 68 and 70 which extend so as to interfere with and provide a wiping contact with a contact portion of a connector unit (not shown) as is well known in the art. The bifurcated portion of the contact 62 is disposed in a contact cavity 24 which is generally X-shaped.

The X-shaped cavity 24 includes joined end wall surfaces 26, 28 and 30 adjacent the arms 64, joined end wall surfaces 32, 34 and 36 adjacent the arm 66, joined end wall surfaces 46, 50 and 54 and opposite joined end wall surfaces 48, 52 and 56 which lie perpendicular to the arms 64 and 66. The inwardly directed and rounded surfaces 46 and 48 serve to guide the mating contact into the cavity 24.

As can be seen in FIG. 2, the surfaces 30 and 36 join with downwardly extending surfaces 38 and 40 of the housing portion 20 and the surfaces 54 and 56 join with downwardly extending surfaces 58 and 60 of the housing portion 20 to define a passageway for receiving the remaining part of the contact 62.

This remaining part of the contact 62 includes a pair of contact fingers 72 and 74 which are spaced apart to define an insulation piercing first slot 76 having opposite open and closed ends and a pair of opposite open sides for receiving and electrically contacting an insulated conductor in a manner which is well known in the art. The fingers 72 and 74 extend downwardly from an arcuate shaped fulcrum 78 and lie within the passageway in a close fit, some flexing being permitted near the tips of the arms 72 and 74 by a pair of outwardly flared surfaces 42 and 44 of the passageway. As an insulated conductor is received between the fingers 72 and 74, and passes by the location where the surfaces 42 and 44 meet the surfaces 38 and 40, spreading of the fingers is prevented to ensure piercing of the insulation and a wiping action of the conductor.

The electrical contact 62 is provided with a plurality of projections 80, 82, 84 and 86 in the portion intermediate the arms 64, 66 and the fingers 72, 74. These projections may advantageously be in the form of barbs and serve two purposes. First of all, it is readily apparent that the projections hold the contact within the housing. Attention is invited, however, to the fact that these projections also effect securement of the housing to the mounting plate 12. During assembly, the contact 62 is partially inserted into the housing to the point where the lower projections 84 and 86 enter the passageway below the surfaces 30 and 36. The housing portion 20 is then inserted through the aperture 14 until a shoulder 88 engages the upper surface of the mounting plate 12, as illustrated in FIGS. 2 and 3. The contact 62 is then inserted to the position shown. During this last insertion operation the material of the housing portion undergoes a cold flow to mushroom as the projections 84 and 86 pass the lower surface of the mounting plate 12 to form an oppositely directed shoulder 90. The housing is then replaceably secured between the shoulders 88 and 90.

The housing portion 20 shields the lower portion of the contact 62 and includes a pair of second slots 92 on opposite sides of the contact fingers 72 and 74 that are formed between a pair of spaced flexible legs or fingers. Each of the slots 92 includes a funnel shaped open end or opening for guiding a conductor into slot 76 and opposed surfaces 94 and 96 which join at an arcuate terminus 98 which forms a shoulder means spaced from the closed end to hold the conductor against retraction from the slots. The arcuate terminus 98 has a diameter that is greater than the spacing between the surfaces 94 and 96 and performs two functions. First of all, as a conductor is forced through the slot 92, and the slot 76, and the fingers 72 and 74 flex, with slightly greater flexing permitted near the ends thereof, the bearing of the conductor on the surfaces 94 and 96 causes the flexible fingers of the insulator to spread apart about a fulcrum located at the arcuate terminus 98. As the conductor is pressed through the slots 92 and passes into the arcuate termini, the flexible fingers move back toward each other to form a strain relief. The conductor is therefore held by the insulator on each side of the insulation piercing portion of the contact.

The conductor is preferably pressed into the slots with an insertion tool which will sever the free end of the conductor at or near the outer surface of the lower housing portion 20.

Additional conductors may be terminated in the same manner, depending on the length of the insulation piercing portion of the contact. For each additional conductor so terminated, an additional conductor locator, similar to the arcuate terminus 98, is provided along the slot 92 in the form of a pair of opposed arcuate surfaces, as indicated at 100 in FIG. 1.

Referring again to FIG. 1, it should be noted that the slots 92 are oriented to lie in the same direction in order to provide uniformity and ease in termination.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. An electrical connector assembly comprising a plurality of electrical contacts, each of said contacts including an active portion for engaging another contact and an insulation piercing contact portion having a pair of fingers projecting rearwardly therefrom and defining an insulation piercing slot for receiving an insulated conductor extending in a direction transverse to the axis of the respective slot, a mounting plate, a plurality of housings each encircling one of said contacts and including insulators shielding the respective insulation piercing portions, each of said insulators including conductor receiving means defining at least one conductor receiving slot aligned with the insulation piercing slot of the respective insulation piercing contact portion, the slot defined by said conductor receiving means of each insulator including means for holding an insulated conductor from retraction from said conductor receiving slot and providing strain relief to said insulator conductor, and means for replaceably securing each housing in said mounting plate intermediate said active portion and the insulation piercing portion in a matrix of housings with the insulators spaced apart and the conductor receiving slots aligned for shielding the respective insulation piercing portions from being inadvertently connected to a conductor located in the aligned slot of another insulator.

2. An electrical connector assembly comprising a contact housing including a first housing portion comprising a first end and a second housing portion comprising a second end and a passageway extending through said housing between said first and second ends, an electrical contact mounted in said passageway and including a first contact portion adjacent said first end of said contact housing and a second contact portion adjacent said second end of said contact housing, said first contact portion adapted for engagement with a mating contact of an associated electrical connector device, said second contact portion including first means defining an insulation piercing slot having an elongate axis and terminating at an open end for receiving and electrically contacting an insulated conductor extending in a direction transverse to said elongate axis, and said second housing portion including second means receiving said first means and defining an open end conductor receiving slot aligned with the insulation piercing slot of said first means and having a closed end spaced from said open end with shoulder means on said second means located in said conductor receiving slot for seating the insulation of said conductor between said shoulder means and closed end to define a holding and strain relief position for said conductor.

3. An electrical connector assembly as claimed in claim 2, wherein said second means further defines said conductor receiving slot as including a pair of surfaces spaced apart to receive a conductor therethrough with a funnel shaped open end spaced for guiding a conductor into the open end of said insulating piercing slot, and said shoulder means is defined by an enlarged arcuate surface joining said spaced surfaces at said closed end to define a position to locate a conductor.

4. An electrical connector assembly as claimed in claim 3 wherein said second means further defines said conductor receiving slot as including at least one pair of oppositely facing arcuate surface portions in respective ones of said spaced surfaces spaced from said enlarged arcuate surface to define a holding position for another conductor.

5. In an electrical connector assembly of the type wherein an electrical contact is mounted in a housing and includes one end with a terminating portion and another end for engagement with a mating contact of a cooperable connector device, the improvement therein comprising:

terminating means on said terminating portion including a pair of fingers defining an insulation piercing slot between two spaced facing surfaces of said fingers for receiving an insulated conductor extending transverse to the axis of said slot and having an open end, and a closed end opposite said open end, and a housing portion extending beyond said closed end toward said open end of said slot and including a pair of legs each engaging the other surfaces of a respective one of said fingers and defining a pair of conductor receiving slots aligned with said insulation piercing slot and in communication with said facing surfaces, and an enlarged arcuate portion in said legs for each of said pair of conductor receiving slots forming a closed end for the pair of conductor receiving slots defined by said legs to seat said conductor and hold said conductor against retraction from said conductor receiving slots and for providing strain relief for the insulated conductor adjacent both open sides of the insulation piercing slot.

6. The improvement in an electrical connector assembly claimed in claim 5 wherein said housing portion adjacent said pair of conductor receiving slots is thickened adjacent the closed end of said insulation piercing slot for added support to the pair of fingers providing an insulation piercing slot and said legs are spaced from said fingers adjacent the open end of said insulation piercing slot for enabling flexure of said fingers.

7. The improvement in an electrical connector assembly claimed in claim 6 wherein said housing portion is shaped to provide support against said fingers for limiting flexing of said fingers transverse to said insulation piercing slot and wherein the housing portion extends beyond the open end of said insulation piercing slot and has a funnel shaped opening spaced for guiding a conductor into the open end of said insulation piercing slot.

* * * * *